US005474051A

United States Patent [19]

Matsumoto et al.

[11] Patent Number: 5,474,051

[45] Date of Patent: Dec. 12, 1995

[54] FAULT DETECTION METHOD AND SYSTEM FOR EXHAUST GAS RECIRCULATION SYSTEM

[75] Inventors: Takuya Matsumoto; Toru Hashimoto; Mitsuhiro Miyake, all of Kyoto, Japan

[73] Assignee: Mitsubishi Jidosha Kogyo Kabushiki Kaisha, Tokyo, Japan

[21] Appl. No.: 297,893

[22] Filed: Aug. 30, 1994

[30] Foreign Application Priority Data

Sep. 3, 1993 [JP] Japan ..... 5-219645

[51] Int. Cl.[6] ..... F02M 25/07

[52] U.S. Cl. ..... 123/571; 73/118.1

[58] Field of Search ..... 123/571; 73/118.1; 364/431.06

[56] References Cited

U.S. PATENT DOCUMENTS

| | | | |
|---|---|---|---|
| 4,715,348 | 12/1987 | Kobayashi et al. | 123/571 |
| 4,762,109 | 8/1988 | Jeenicke | 123/571 |
| 4,974,572 | 12/1990 | Aramaki | 123/571 |
| 5,005,552 | 4/1991 | Kawamura | 123/571 |
| 5,014,203 | 5/1991 | Miyazaki et al. | 364/431.06 |
| 5,103,655 | 4/1992 | Kano et al. | 73/118.1 |
| 5,137,004 | 8/1992 | Takahata et al. | 123/571 |
| 5,150,695 | 9/1992 | Kondo | 123/571 |
| 5,154,156 | 10/1992 | Ohuchi | 123/571 |
| 5,205,260 | 4/1993 | Takahashi et al. | 123/571 |
| 5,309,887 | 5/1994 | Kondo et al. | 123/571 |
| 5,368,005 | 11/1994 | Kako | 123/571 |

FOREIGN PATENT DOCUMENTS

| | | |
|---|---|---|
| 4122377 | 7/1991 | Germany . |
| 4219339 | 6/1992 | Germany . |
| 4231316 | 9/1992 | Germany . |

*Primary Examiner*—Willis R. Wolfe

*Attorney, Agent, or Firm*—Birch, Stewart, Kolasch & Birch

[57] ABSTRACT

A fault detection system is provided for an exhaust gas recirculation (EGR) system. The fault detection system is constructed of an engine operation state detection device, an EGR valve opening/closing device, and a system operation fault detection device. The engine operation state detection device is provided with an air flow sensor arranged in an intake passage on an upstream side of a throttle valve, and detects the engine operation state that the pressure difference between a pressure within an intake passage on a downstream side of the throttle valve and a pressure within the intake passage on an upstream side of the throttle valve is not greater than a critical pressure. Upon detection of the above engine operation state, the EGR valve opening/closing device opens or closes an EGR valve. When a change in the output from the air flow sensor between before and after the opening or closing of the EGR valve is detected to be smaller than a predetermined fault determination value, the system operation fault detection device detects that the EGR system is not operating properly. A fault determination zone is set by avoiding a critical pressure operation zone, so that a fault in the operation of the system can be detected with good accuracy.

17 Claims, 9 Drawing Sheets

FAULT DETECTION METHOD AND SYSTEM FOR EXHAUST GAS RECIRCULATION SYSTEM

BACKGROUND OF THE INVENTION

1. Field of the Invention

This invention relates to an exhaust gas recirculation (EGR system) in which an exhaust gas recirculation passage (EGR passage) extending between an intake system and an exhaust system in an internal combustion engine is opened or closed by an exhaust gas recirculation valve (EGR valve) to selectively recirculate exhaust gas to the intake system, and especially to a method and system for the detection of a fault of such an EGR system.

2. Description of the Related Art

As a conventional fault detection system for an EGR system, there has been proposed such a system that an EGR valve is opened or closed in an EGR operation zone but if the difference between a value detected on the volume of air inducted before the opening or closure and that detected after the opening or closure falls within a predetermined range, an alarm is given [see Japanese Patent Application Laid-Open (Kokai) No. SHO 62-51747].

Such a conventional fault detection system for an EGR system however performs a self-diagnosis even when the pressure difference between a pressure within said throttle valve downstream side intake passage and a pressure within said throttle valve upstream side intake passage exceeds a critical pressure as in an operation zone in which the throttle valve is controlled at a low angle. The term "critical pressure" as used herein means a pressure at which the flow velocity of inducted air flowing past the throttle valve reaches the velocity of sound, for example, a pressure of 420–430 mmHg on the downstream side of the throttle valve when the pressure on the upstream side of the throttle valve, namely, the atmospheric pressure is 760 mmHg. Paying attention to the difference between a value detected on the volume of air inducted before the opening or closure of the EGR valve and that detected after the opening or closure, this difference falls within the predetermined range in the above case even if the EGR system is in order. The conventional fault detection system therefore involves the potential problem that the EGR system is erroneously determined to be out of order, resulting in production of an alarm.

SUMMARY OF THE INVENTION

With the foregoing in view, the present invention has as a primary object thereof the provision of a method and system for the detection of a fault of an exhaust gas recirculation system, which method and system avoid a critical pressure operation zone as a fault determination zone so that any improper operation of the EGR system can be detected accurately.

In one aspect of the present invention, there is thus provided a method for the detection of a fault of an exhaust gas recirculation system, said exhaust gas recirculation system having an exhaust gas recirculation passage connecting a throttle valve downstream side intake passage, which is arranged on a side downstream the position of arrangement of a throttle valve in an internal combustion engine, and an exhaust passage with each other and an exhaust gas recirculation valve inserted in the exhaust gas recirculation passage, whereby the exhaust gas recirculation valve is opened or closed to selectively recirculate exhaust gas in the exhaust passage to a side of the intake passage through the exhaust gas recirculation passage, which comprises:

opening or closing the exhaust gas recirculation valve upon detection of the engine operation state that the pressure difference between a pressure within the throttle valve downstream side intake passage and a pressure within a throttle valve upstream side intake passage on an upstream side of the position of arrangement of the throttle valve is not greater than a critical pressure; and detecting a change in the volume of air inducted through the throttle valve upstream side intake passage between before and after the opening or closing of the exhaust gas recirculation valve, and if the change in the volume of inducted air is determined smaller than a predetermined fault determination value, detecting that the exhaust gas recirculation system is not operating properly.

In another aspect of the present invention, there is also provided a fault detection system for an exhaust gas recirculation system having an exhaust gas recirculation passage connecting a throttle valve downstream side intake passage, which is arranged on a side downstream the position of arrangement of a throttle valve in an internal combustion engine, and an exhaust passage with each other and an exhaust gas recirculation valve inserted in the exhaust gas recirculation passage, whereby the exhaust gas recirculation valve is opened or closed to selectively recirculate exhaust gas in the exhaust passage to a side of the intake passage through the exhaust gas recirculation passage, which comprises:

means for detecting the volume of air inducted through a throttle valve upstream side intake passage on an upstream side of the position of arrangement of the throttle valve, said inducted air volume detection means being disposed in the throttle valve upstream side intake passage;

means for detecting the state of operation of the engine that the pressure difference between a pressure within the throttle valve downstream side intake passage and a pressure within the throttle valve upstream side intake passage is not greater than a critical pressure;

means for opening or closing the exhaust gas recirculation valve upon detection by the engine operation state detection means of the engine operation state that the pressure difference between the pressure within the throttle valve downstream side intake passage and the pressure within the throttle valve upstream side intake passage is not greater than the critical pressure; and means for detecting that the exhaust gas recirculation system is not operating properly when a change in the output of the inducted air volume detection means between before and after the opening or closing of the exhaust gas recirculation valve has been determined to be smaller than a predetermined fault determination value.

The engine operation state detection means may be constructed to compare the state of load on the internal combustion engine with a predetermined threshold and when the state of load on the internal combustion engine is found to be greater than the threshold on the basis of the results of the comparison, detects the engine operation state that the pressure difference is not greater than the critical pressure. The engine operation state detection means may be provided preferably with means for changing the threshold depending on whether the exhaust gas recirculation valve is open or closed.

Preferably, a threshold for the case that the exhaust gas recirculation valve is open may be set greater than a threshold for the case that the exhaust gas recirculation valve is closed.

Irrespective of the position of the exhaust gas recirculation valve, said exhaust gas recirculation valve opening/closing means may be constructed to open or close the exhaust gas recirculation valve upon detection of the engine operation state that the pressure difference is not greater than the critical pressure.

The exhaust gas recirculation valve opening/closing means may be provided with:

means for holding the exhaust gas recirculation valve in an open position for a predetermined time upon detection of the engine operation state that the pressure difference is not greater than the critical pressure when the exhaust gas recirculation valve is in a closed position in the initial state; and means for returning the exhaust gas recirculation valve into the closed position after holding the exhaust gas recirculation valve in the open position for the predetermined time by the exhaust gas recirculation valve position holding means; or the exhaust gas recirculation valve opening/closing means may be provided with:

means for holding the exhaust gas recirculation valve in a closed position for a predetermined time upon detection of the engine operation state that the pressure difference is not greater than the critical pressure when the exhaust gas recirculation valve is in an open position in the initial state; and means for returning the exhaust gas recirculation valve into an open position after holding the exhaust gas recirculation valve in the closed position for the predetermined time by the exhaust gas recirculation valve position holding means.

Preferably, the fault determination value retained by the system operation fault detection means has been set using the state of load on the internal combustion engine as a parameter.

The fault detection system may further comprise: means for detecting the temperature of coolant of the internal combustion engine; means for detecting the temperature of air inducted into the internal combustion engine; and means for inhibiting operation of the exhaust gas recirculation valve opening/closing means when one of the coolant temperature detected by the coolant temperature detection means and the inducted air temperature detected by the inducted air temperature detection means is smaller than a preset value. In this case, the operation inhibiting means may be constructed to inhibit initiation of operations of the exhaust gas recirculation opening/closing means and the system operation fault detection means when one of the coolant temperature detected by the coolant temperature detection means and the inducted air temperature detected by the inducted air temperature detection means has been detected to be smaller than the preset value prior to the initiation of operations of the exhaust gas recirculation opening/closing means and the system operation fault detection means.

The fault detection system may further comprise: means for detecting the state of operation of the internal combustion engine; means for determining whether or not the state of operation of the internal combustion engine detected by the operation state detection means is stable; and means for inhibiting operation of the exhaust gas recirculation valve opening/closing means when the state of operation of the internal combustion engine has been determined instable by the determination means.

In this case, the operation inhibiting means may be constructed to inhibit initiation of operations of the exhaust gas recirculation opening/closing means and the system operation fault detection means when the state of operation of the internal combustion engine has been determined instable during operations of the exhaust gas recirculation opening/closing means and the system operation fault detection means.

The operation inhibiting means may be constructed to inhibit continuation of operations of the exhaust gas recirculation opening/closing means and the system operation fault detection means when the state of operation of the internal combustion engine has been determined instable during operations of the exhaust gas recirculation opening/closing means and the system operation fault detection means.

The fault detection system may further comprise means for inhibiting normal operation of the exhaust gas recirculation control means, said normal operation opening or closing the exhaust gas recirculation valve depending on the state of operation of the internal combustion engine, during operations of the exhaust gas recirculation opening/closing means and the system operation fault detection means.

The fault detection system may further comprise means for displaying detection of a fault in the operation of the exhaust gas recirculation system upon detection of the fault by the system operation fault detection means.

The fault detection system may further comprise memory means for storing detection of a fault in the operation of the exhaust gas recirculation system upon detection of the fault by the system operation fault detection means and tester means for permitting output of information on the fault in the operation of the exhaust recirculation system, said fault having been stored in the memory means.

According to the present invention, upon detection of the engine operation state that the pressure difference between a pressure within the throttle valve downstream side intake passage and a pressure within the throttle valve upstream side intake passage on the upstream side of the position of arrangement of the throttle valve is not greater than a critical pressure, the exhaust gas recirculation valve is opened or closed and depending on a change in the volume of air inducted through the throttle valve upstream side intake passage between before and after the opening or closing of the exhaust gas recirculation valve, any improper operation of the exhaust gas recirculation system is detected. It is hence possible to avoid as a fault determination zone a critical pressure operation zone, resulting in the advantage that a fault in the operation of the exhaust gas recirculation system can be detected with good accuracy without needing addition of any special sensor or the like.

DESCRIPTION OF THE PREFERRED EMBODIMENT

The fault detection system according to the one embodiment of the present invention for the EGR system will hereinafter be described with reference to the accompanying drawings.

Figure 2:
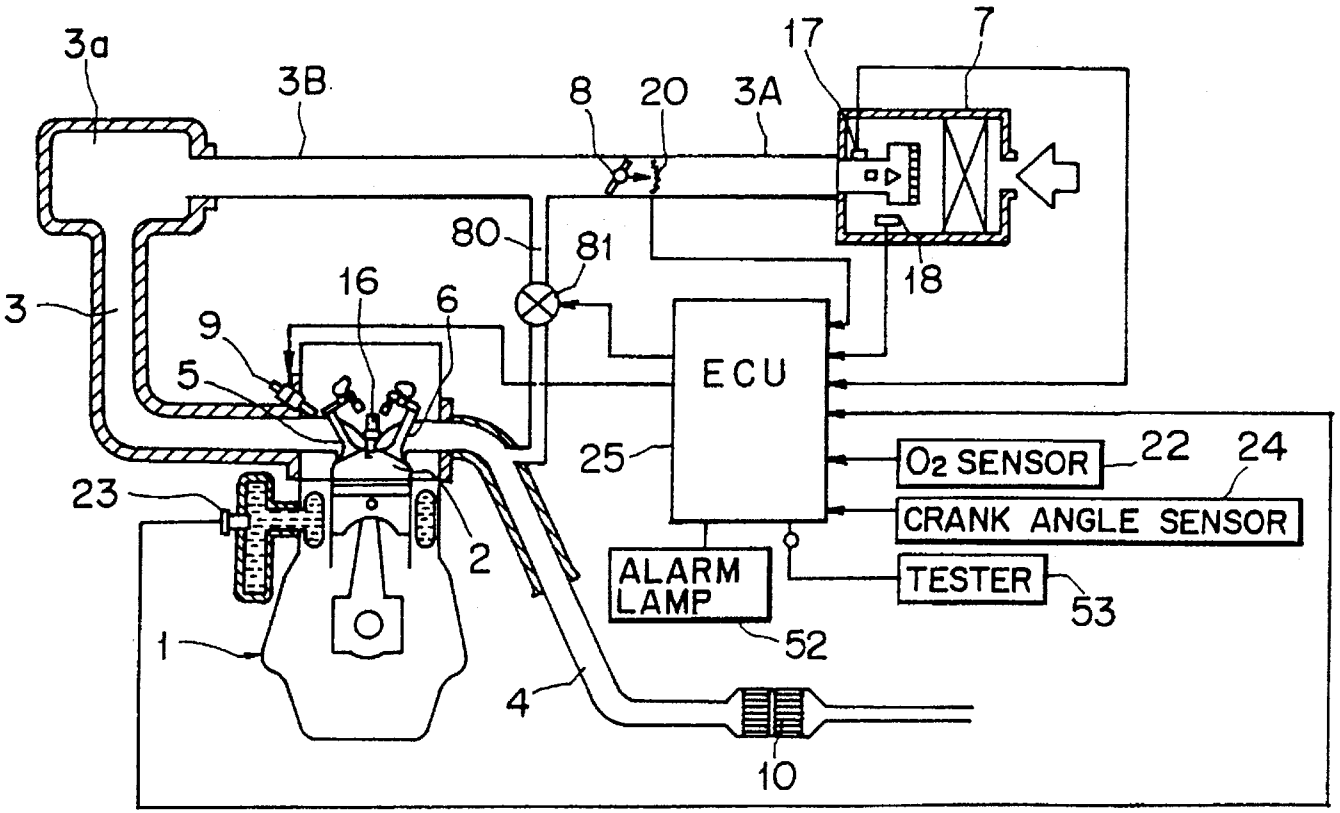
FIG. 2 is an overall construction diagram showing an engine system, which is equipped with the fault detection system, together with a control system for the engine system.

An engine system for an automotive vehicle in which the fault detection system can be installed may be illustrated as shown in FIG. 2. In FIG. 2, an engine 1 has an intake passage 3 and an exhaust passage 4, both of which are communicated to a combustion chamber 2. The communication between the intake passage 3 and the combustion chamber 2 is controlled by an intake valve 5, while the communication between the exhaust passage 4 and the combustion chamber 2 is controlled by an exhaust valve 6.

The intake passage 3 is provided with an air cleaner 7, a throttle valve 8 and an electromagnetic fuel injection valve (injector) 9, which are arranged successively from an upstream side of the intake passage 3. The exhaust passage 4, on the other hand, is provided with a catalytic converter (three-way catalyst) 10 for the purification of exhaust gas and an unillustrated muffler (noise eliminator) successively from an upstream side of the exhaust passage 4. The intake passage 3 is also provided with a surge tank 3*a*. The throttle valve 8 is connected to an accelerator pedal (not shown) by way of a wire cable, whereby its position (opening) varies depending on the amount of depression of the accelerator pedal.

Incidentally, an exhaust gas recirculation passage (EGR passage) 80 is interposed between a throttle valve downstream side intake passage 3B on a side downstream the position of arrangement of the throttle valve 8 and the exhaust passage 4. In this EGR passage 80, an electromagnetic exhaust gas recirculation valve (EGR valve) 81 is inserted.

To control the state of operation of the engine 1, various sensors are arranged. A portion (throttle valve upstream side intake passage) 3A where intake air flowed past the air cleaner 7 flows into the intake passage 3 is provided with an air flow sensor (inducted air volume detecting means) 17 for detecting the volume of inducted air from Karman vortex information and an intake air temperature sensor (intake air temperature detecting means) 18.

At the position of arrangement of the throttle valve 8 in the intake passage 3, there are arranged a throttle position sensor 20 in the form of a potentiometer for detecting the position of the throttle valve 8 as well as an idling switch for mechanically detecting a fully closed state of the throttle valve 8 (i.e., an idling state) from the position of the throttle valve 8.

on the side of the exhaust passage 4, on the other hand, an oxygen concentration sensor ($O_2$ sensor) 22 for detecting the concentration of oxygen ($O_2$ concentration) in the exhaust gas is disposed on an upstream side of the catalytic converter 10. Other sensors include a coolant temperature sensor (coolant temperature detecting means) 23 for detecting the temperature of coolant of the engine 1 (a coolant temperature) and a crank angle sensor 24 for detecting a crank angle (which can also function as a speed sensor for detecting an engine speed Ne)

Detection signals from these sensors are inputted to an electronic control unit (ECU) 25.

ECU 25 is provided as a principal component thereof with CPU (central processing unit) 26. Further, CPU 26 is arranged to exchange data through bus lines with memories (storage means), such as ROM which stores various data in addition to program data and fixed value data, RAM which can be updated, i.e., can be successively rewritten and a battery-backed-up RAM which can hold stored information as long as connected to a battery.

As a result of computation by CPU, signals for controlling the state of operation of the engine 1, for example, various control signals such as a fuel injection control signal, an ignition timing control signal, an EGR control signal and an alarm lamp lighting signal are outputted from ECU 25. Further, fault code information, for example, on the EGR system is also outputted from ECU 25.

The fuel injection control (air/fuel ratio control) signal is outputted to the injector 9, the ignition timing control signal to an ignition timing control power transistor, and the EGR control signal to the EGR valve 81. Further, the alarm lamp lighting signal is outputted to an alarm lamp 52 and when a tester 53 is connected, the fault code information is outputted to the tester 53.

Figure 1:
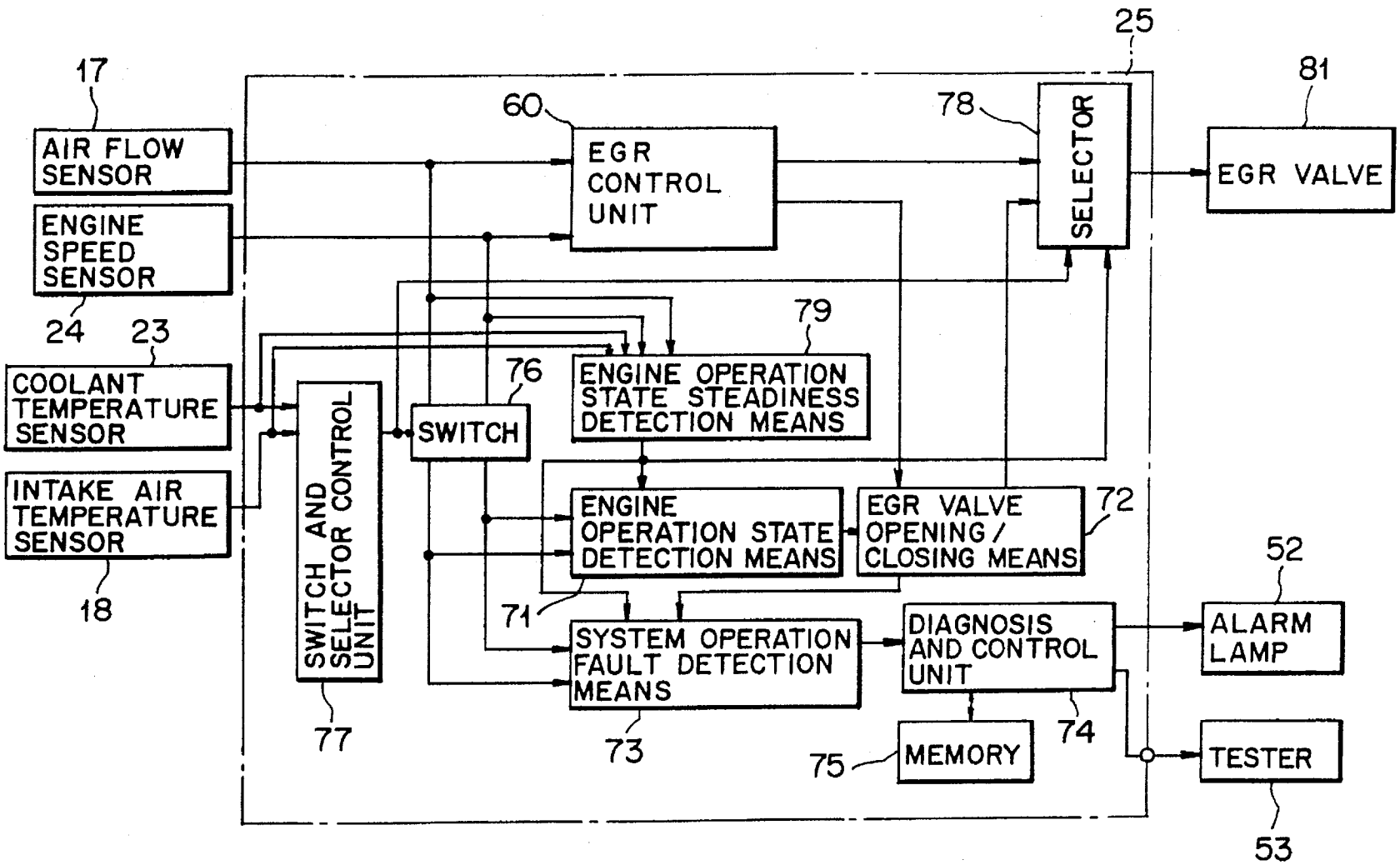
FIG. 1 is a block diagram of a fault detection system according to one embodiment of the present invention for an EGR system.

Now paying attention to EGR control by the EGR system, ECU 25 is equipped with an EGR control unit 60 for the EGR control as illustrated in FIG. 1. This EGR control unit 60 determines from engine load information and engine speed information whether or not the engine 1 is in an EGR operation zone. If in the EGR operation zone, the EGR valve 81 is driven to a predetermined angle to control the volume of exhaust gas (EGR volume) to be recirculated through the EGR passage 80.

In the illustrated embodiment, ECU 25 also functions as a fault detection unit for the EGR system. This fault detection unit is constructed, as shown in FIG. 1, of engine operation state detection means 71, EGR valve opening/closing means 72, a system operation fault detection means 73, a diagnosis and control unit 74, a memory 75, a switch 76, a switch and selector control unit 77 and engine operation state steadiness detection means 79. ECU 25 also functions as a selector 78 which selects whether the EGR valve 81 is controlled in the control mode relying upon the EGR control unit 60 or in the operation mode of this fault detection unit.

The engine operation state detection means 71 detects the engine operation state that the pressure difference between a pressure within the throttle valve downstream side intake passage 3B and a pressure within the throttle valve upstream side intake passage 3A is not greater than a critical pressure which is, for example, a pressure of 330–340 mmHg. Described specifically, the engine operation state detection means 71 compares the state of load on the engine with a predetermined threshold and when the state of load on the engine is found to be equal to or greater than the predetermined threshold on the basis of the result of the comparison, detects that the engine is in an operation state in which the pressure difference is not greater than the above critical pressure. The engine operation state detection means 71 is also provided with means for varying the threshold depending on whether the EGR valve 81 is open or closed.

The EGR valve opening/closing means 72 opens or closes the EGR valve 81 upon detection by the engine operation state detection means 71 of an engine operation state that the pressure difference between a pressure within the throttle valve downstream side intake passage 3B and a pressure within the throttle valve upstream side intake passage 3A is not greater than the critical pressure. If the EGR valve 81 is in an open position at the beginning, for example, the EGR valve 81 is closed for a predetermined time $T_{OFF1}$, which is set by a timer, after the detection and is then returned to an open position (detection of a fault in MODE 1). If the EGR valve 81 is in the closed position at the beginning, on the other hand, the EGR valve 81 is opened for a predetermined time $T_{OFF1}$, which is set by the timer, after the detection and is then returned to the closed position (detection of a fault in MODE 2).

Figure 9:
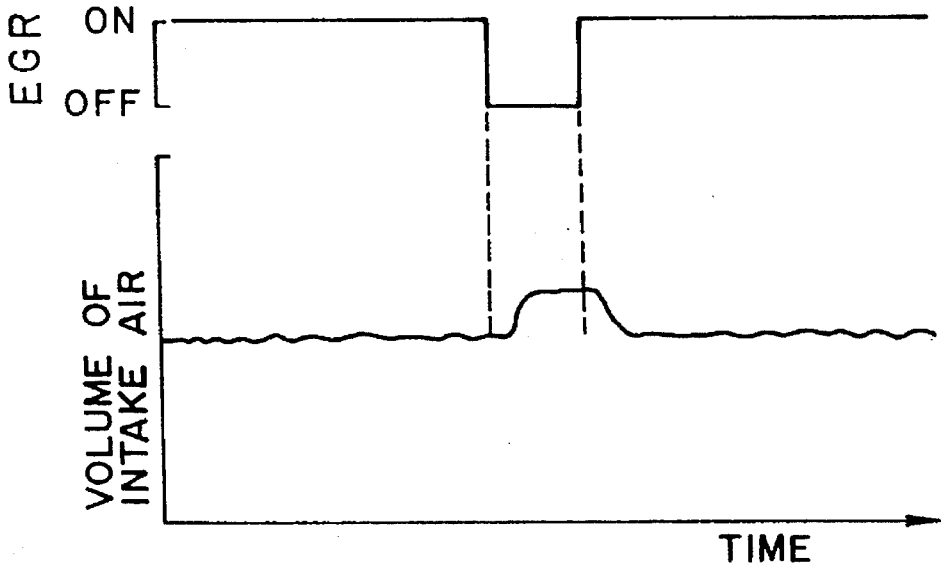
FIG. 9 is a diagram illustrating effects of the fault detection system.

When a change in the output of the air flow sensor 17 between before and after the opening or closure of the EGR valve 81 is determined to be smaller than a predetermined fault determination value, the system operation fault detection means 73 detects that the EGR system is not operating properly. When the EGR valve 81 is opened and closed in an engine operation state that the above pressure difference is not greater than the critical pressure, the volume of inducted air varies as shown in FIG. 9 provided that the EGR valve 81 is operating properly. It is therefore possible to diagnose the state of operation of the EGR system in accordance with a change in the volume of inducted air. In this case, the fault determination value retained by the system operation fault detection means 73 is set by using the state of load on the engine as a parameter.

Based on the result of detection by the system operation fault detection means 73, the diagnosis and control unit 74 generates a signal for lighting the alarm lamp 52, store fault code information in the memory 75, or reads fault code information from the memory to a side of the tester 53.

Namely, the diagnosis and control unit 74 is provided with indicator means 52 for indicating a fault in the operation of the exhaust gas recirculation system upon detection of the fault by the system operation fault detection means 73, memory means 75 for storing the fault in the operation of the exhaust gas recirculation system upon detection of the fault by the system operation fault detection means 73, and tester means 53 for reading the information stored in the memory means 75 to the effect that the exhaust gas recirculation system is not operating properly.

The switch 76 is turned off when one of the coolant temperature WT and the intake air temperature AT is not equal to or higher than a preset corresponding value $TH_W$ or $TH_A$, thereby stopping input of engine load information and engine speed information to the engine operation state detection means 71 and the system operation fault detection means 73. The switch and selector control unit 77 hence receives information on the coolant temperature and the intake air temperature and controls the switch 76 and the selector 78.

Described specifically, the switch 76 is also provided with means for inhibiting operation of the EGR valve opening/closing means 72 if one of the coolant temperature WT and the intake air pressure AT is smaller than the corresponding preset value $TH_W$ or $TH_A$. The operation inhibiting means is constructed so that if one of the coolant temperature WT and the intake air temperature AT is detected to be lower than the corresponding preset value $TH_W$ or $TH_A$ before initiation of operations of the EGR valve opening/closing means 72 and the system operation fault detection means 73, the EGR valve opening/closing means 72 and the system operation fault detection means 73 are inhibited from initiation of operations.

When a variation takes place in the state of operation of the engine which is determined by the engine load and the engine speed, the engine operation state steadiness detection means 79 detects this variation and even if the coolant temperature WT and the intake air temperature AT are higher than their corresponding preset values $TH_W$,$TH_A$, resets the engine operation state detection means 71 and the system operation fault detection means 73.

Although the engine operation state steadiness detection means 79 is provided with means for determining whether or not the state of operation of the internal combustion engine 1 detected by the operation state detection means (the air flow sensor 17, the engine speed sensor 24, etc.) is stable and also with means for inhibiting operation of the EGR valve opening/closing means 72 when the state of operation of the internal combustion engine 1 is determined not stable by the above determination means, the operation inhibiting means is constructed to inhibit initiation of operations of the EGR opening/closing means 72 and the system operation fault detection means 73 if the state of operation of the internal combustion engine 1 is determined not to be stable by the determination means prior to the initiation of operations of the EGR valve opening/closing means 72 and the system operation fault detection means 73. As an alternative, the operation inhibiting means may be constructed to inhibit continuation of operations of the EGR valve opening/closing means 72 and the system operation fault detection means 73 if the state of operation of the internal combustion engine 1 is determined not to be stable by the determination value during the operations of the EGR valve opening/closing means 72 and the system operation fault detection means 73.

The engine operation state steadiness detection means 79 is also provided with means for inhibiting, during operations of the EGR valve opening/closing means 72 and the system operation fault detection means 73, the normal operation of the EGR control means 60 that the EGR valve 81 is opened or closed depending on the state of operation of the internal combustion engine 1.

The detection method of a fault of the EGR system will next be described with reference to the flow charts of FIG. 3 to FIG. 8.

Concurrently with initiation of operation of the EGR system, the fault detecting flows of this embodiment are also started. Whether or not the EGR system has already been determined to be in order is first determined in step A1 shown in FIG. 3 by checking if a normality determination end flag $F_{OK}$ is 1.

Since the normality determination end flag $F_{OK}$ is set at 0 until normality is determined but is set at 1 after the end of the determination of the normality, the routine first takes in step A1 the route that $F_{OK}$ is not 1. Next in step A2, whether or not the engine is under diagnostic monitoring is determined depending on whether or not the normality determination end flag $F_{MON}$ is 1.

Since a monitoring flag $F_{MON}$ is set at 1 during monitoring but otherwise at 0, the routine first takes the route that $F_{MON}$ is not 1 (step A2).

In steps A3,A4, it is then determined whether or not the coolant temperature WT and the intake air temperature AT are not smaller than their corresponding preset values $TH_W$, $TH_A$, respectively. If so, an initializing subroutine (INITIAL subroutine) is started in step A5. If the coolant temperature WT and the intake air temperature AT are not equal to or greater than their corresponding preset values, respectively, the routine returns without performing anything.

Figure 4:
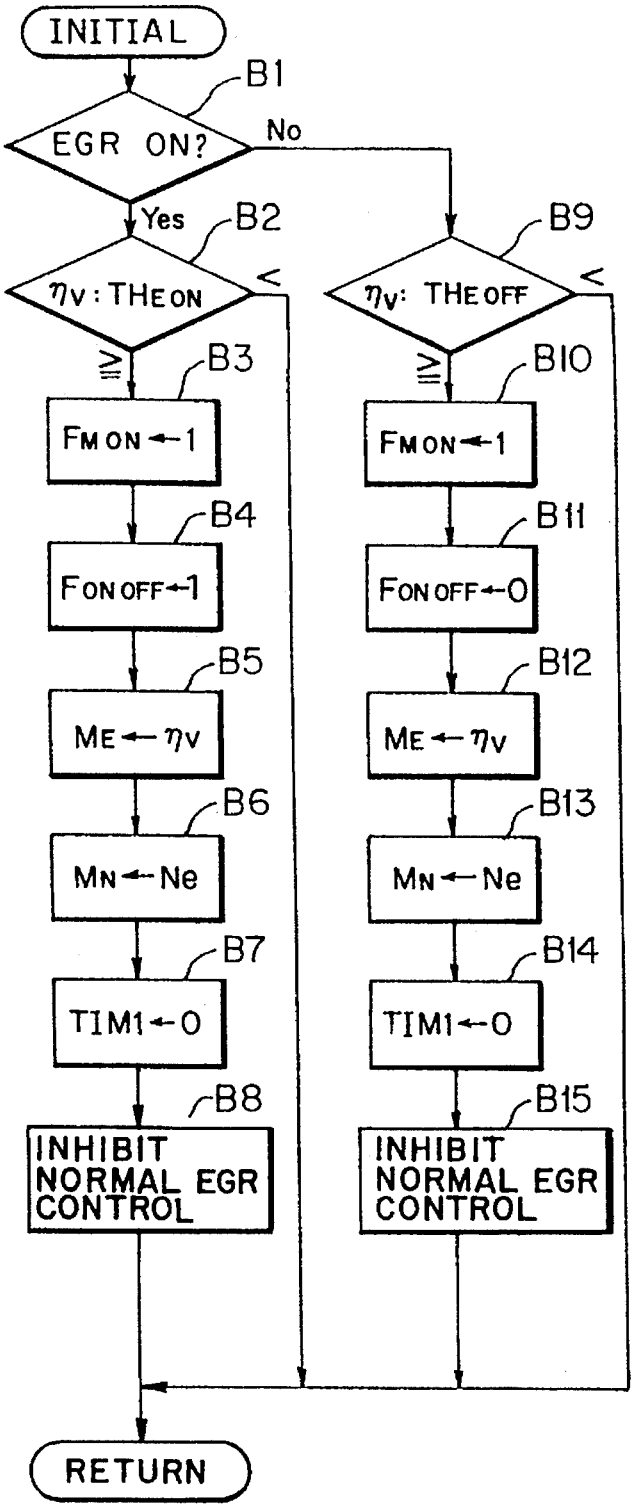
FIG. 4 is a flow chart describing operations by the fault detection system.

When the INITIAL subroutine is started, it is then determined, as shown in FIG. 4, whether the EGR system is on (i.e., the EGR valve is open) (step B1). If so, it is determined in step B2 whether a volumetric efficiency $\eta_v$ containing engine load information is greater than a monitoring initiation determining threshold $TH_{EON}$, in other words, whether the engine is in such an operation state that the pressure difference between the pressure within the throttle valve downstream side intake passage 3B and the pressure within the throttle valve upstream-side intake passage 3A can be maintained not greater than a critical pressure even after the EGR system is turned off.

Where the volumetric efficiency $\eta_v$ is equal to or greater than the threshold $TH_{EON}$, in other words, where the engine is in such an operation state as permitting maintenance of the pressure difference between the pressure within the throttle valve downstream side intake passage 3B and the pressure within the throttle valve upstream side intake passage 3A equal to or smaller than the critical pressure even after the EGR system is turned off, the monitoring flag $F_{MON}$ is set at 1 and a flag $F_{ONOFF}$ is set at 1 (steps B3, B4), the current volumetric efficiency $\eta_v$ (engine load) and engine speed Ne are read (steps B5, B6), the timer count TIM1 of the first timer is reset to 0 (step B7), and the normal EGR control is then inhibited (step B8).

Unless the EGR system is found to be on (i.e., the EGR valve is open) in step B1, it is then determined in step B9 whether the volumetric efficiency $\eta_v$ containing engine load information is greater than the monitoring initiation determining threshold $TH_{EOFF}$, in other words, whether the engine is in such an operation state that the pressure difference between the pressure within the throttle valve downstream side intake passage 3B and the pressure within the throttle valve upstream side intake passage 3A becomes not greater than the critical pressure when the EGR system is off.

It is to be noted that the different monitoring initiation determining thresholds $TH_{EON}$ and $TH_{EOFF}$ are set depending on whether the EGR valve 81 is open or closed. In general, they are set to satisfy the following inequality: $TH_{EOFF}<THEO_N$, because when diagnosis of a fault is initiated while the EGR system is on, the pressure difference may exceed the critical pressure when the EGR system is turned off in the course of the diagnosis even if the pressure difference is not greater the critical pressure at the time of its initiation, that is, when the EGR system is on.

If the volumetric efficiency $\eta_v$ is equal to or greater than the threshold $TH_{EOFF}$, in other words, if the engine in such an operation state that the pressure difference between the pressure within the throttle valve downstream side intake passage 3B and the pressure within the throttle valve upstream side intake passage 3A becomes equal to or smaller than the critical pressure when the EGR system is off, the monitoring flag $F_{MON}$ is set at1 and the flag $F_{ONOFF}$ is set at 0 (steps B10, B11), the current volumetric efficiency $\eta_v$ (engine load) and engine speed Ne are read (steps B12, B13), the timer count TIM1 of the first timer is reset to 0 (step B14), and the normal EGR control is then inhibited (step B15).

As has been described above, the monitoring initiating initialization is conducted when the volumetric efficiency $\eta_v$ is equal to or greater than the threshold $TH_{EON}$ or $TH_{EOFF}$, in other words, when the engine is in such an operation state that the pressure difference between the pressure within the throttle valve downstream side intake passage 3B and the pressure within the throttle valve upstream side intake passage 3A becomes equal to or smaller than the critical pressure.

when the volumetric efficiency $\eta_v$ is not equal to or greater than the threshold $TH_{EON}$ or $TH_{EOFF}$, in other words, when the engine is in such an operation state that the pressure difference between the pressure within the throttle valve downstream side intake passage 3B and the pressure within the throttle valve upstream side intake passage 3A becomes greater than the critical pressure, the routine returns without conducting the monitoring initiating initialization. As a consequence, no fault detection of the EGR system is performed in this case.

Figure 3:
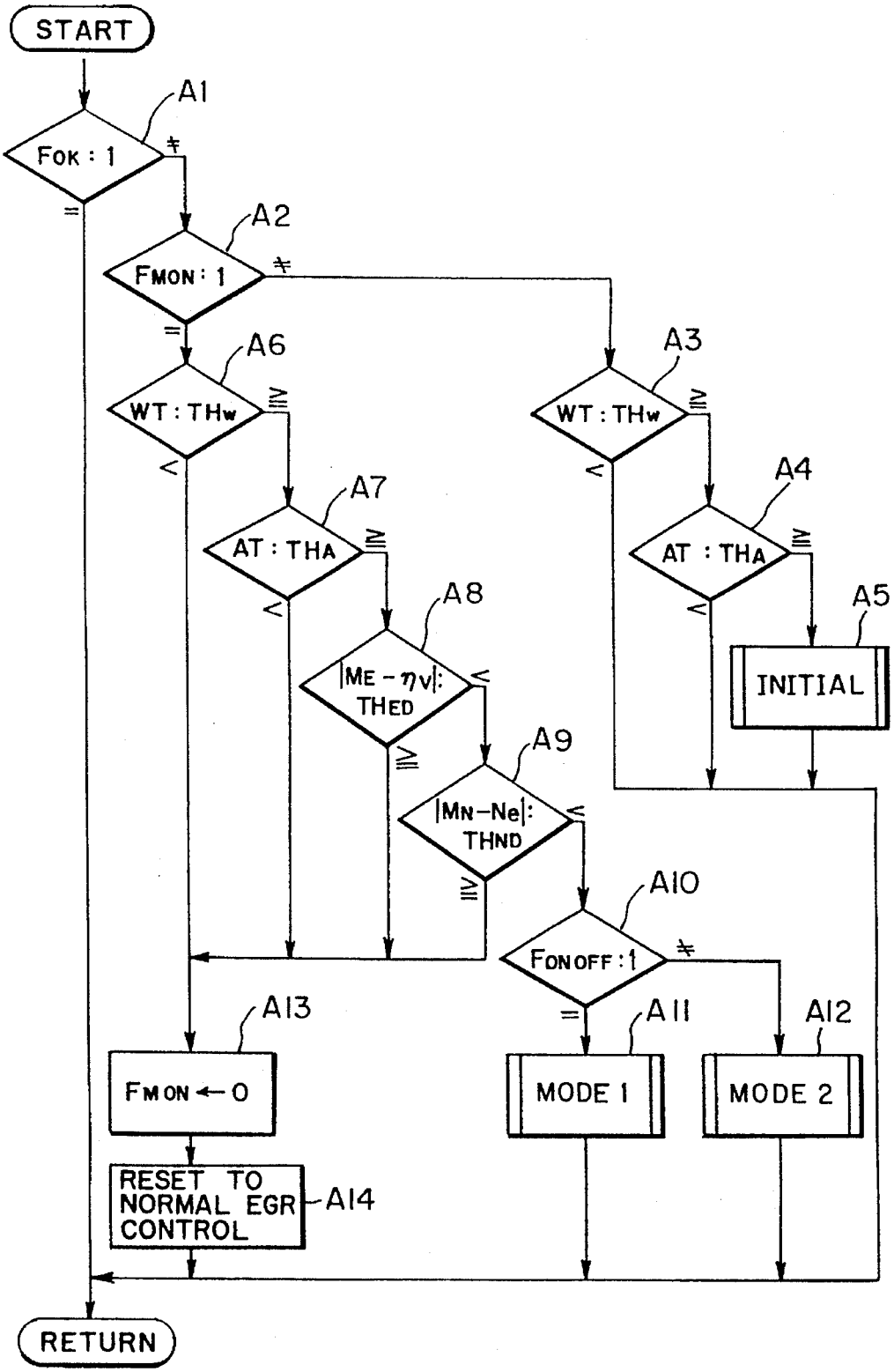
FIG. 3 is a flow chart describing operations by the fault detection system.

When the initialization is conducted as described above, the monitoring flag $F_{MON}$ becomes 1, so that in step A2 of FIG. 3, the routine advances along the route for the monitoring flag $F_{MON}$=1. In steps A6 and A7, it is determined whether the coolant temperature WT and the intake air temperature AT are not smaller than their corresponding preset values $TH_W$,$TH_A$. If so, it is then determined in steps A8, A9 whether the state of operation of the engine is stable or not by comparing the state of operation of the engine at the time of the initialization with the current state of operation of the engine.

If the state of operation of the engine is stable (i.e., steady), it is then determined in step A10 whether the flag $F_{ONOFF}$ is 1. If the EGR valve was determined to be open at the time of the initialization, the flag $F_{ONOFF}$ is 1. The routine therefore advances along the YES route in step A10, so that a MODE1 subroutine is started (step A11). If the EGR valve was determined to be closed at the time of the initialization, on the other hand, the flag $F_{ONOFF}$ is 0. The routine therefore advances along the NO route in step A10, so that a MODE2 subroutine is started (step A12).

Where the coolant temperature WT and intake air temperature AT were not equal to or greater than $TH_W$ and $TH_A$, respectively, or where there was a variation in the state of operation of the engine, the monitoring flag $F_{MON}$ is set at 0 in step A13 so that the fault determination processing is reset. In this case, it is necessary to cancel the normal EGR control inhibition processing, which has been performed in the INITIAL subroutine, and to return the control to the normal EGR control mode (step A14).

Figure 5:
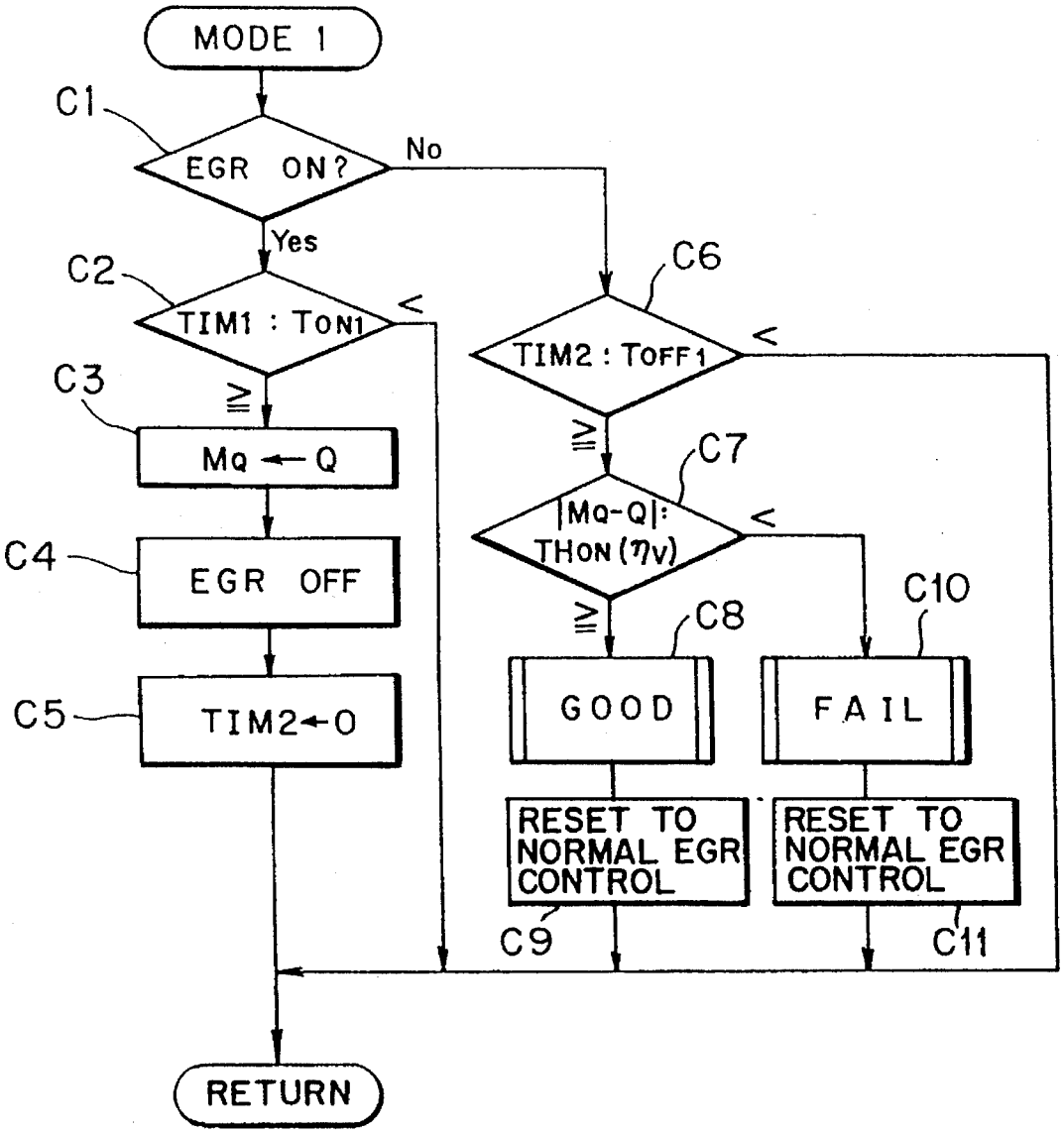
FIG. 5 is a flow chart describing operations by the fault detection system.

Incidentally, when the MODE1 subroutine is started, it is determined as shown in FIG. 5 whether the EGR system is on (the EGR valve is open) (step C1). Since the EGR system is on (the EGR valve is open) in an initial stage after the MODE1 subroutine has been started, it is determined in step C2 whether the count TIM1 of the first tiller has reached a preset time $T_{ON1}$. To determine whether the count TIM1 of the first timer has reached the present time $T_{ON1}$ as described above is to determine whether the ON state of the EGR system (the open state of the EGR valve) has continued for a certain time after the initialization.

As the count TIM1 of the first timer has not reached the preset time $T_{ON1}$ in the beginning, the routine returns directly. When the count TIM1 of the first timer has reached the preset time TON1, the current inducted air volume Q is read in step C3. After closing the EGR valve 81 to turn off the EGR system (step C4), the count TIM2 of the second timer is reset to 0 (step C5).

since the EGR system has been turned off in step C4, the routine advances taking the NO route in step C1. It is then determined in step C6 whether the count TIM2 of the second timer has reached the preset OFF time $T_{OFF1}$. No further processing is performed until the count TIM2 of the second timer reaches the preset OFF time $T_{OFF1}$. Upon an elapsed time of the preset OFF time $T_{OFF1}$, it is then determined in step C7 whether the change in the output of the air flow sensor 17 between before and after the opening or closure of the EGR valve 81 is not smaller than the predetermined fault determination value. In other words, it is determined whether the difference (absolute value) between an inducted air volume $M_Q$ measured when the EGR system was on, said volume having been read in step C3, and the current inducted air volume Q [measured when the EGR system is off; described correctly, measured at a time point set in view of a lag in a change of inducted air volume (see FIG. 9)] is not smaller than the fault determination value $TH_{ON}$. In this case, the fault determination value $TH_{ON}$ is set by using the state of load on the engine (volumetric efficiency $\eta_v$) as a parameter.

If the difference between the volume of air inducted when the EGR system was on and the volume of air inducted currently (when the EGR system is off) is not smaller than the fault determination value $TH_{ON}$, the EGR system is determined to be in order (step C8) so that a GOOD subroutine is started. In the subsequent step C9, the control is returned to the normal EGR control.

If the difference between the volume of air inducted when the EGR system was on and the volume of air inducted now (when the EGR system is off) is not equal to or greater than the fault determination value $TH_{ON}$, the EGR system is determined to be out of order so that a FAIL subroutine is started (step C10). In the subsequent step C11, the control is returned to the normal EGR control.

Incidentally, the determination whether the EGR system is in order or out of order is not conducted while the preset OFF time $T_{OFF1}$ has not elapsed.

Figure 7:
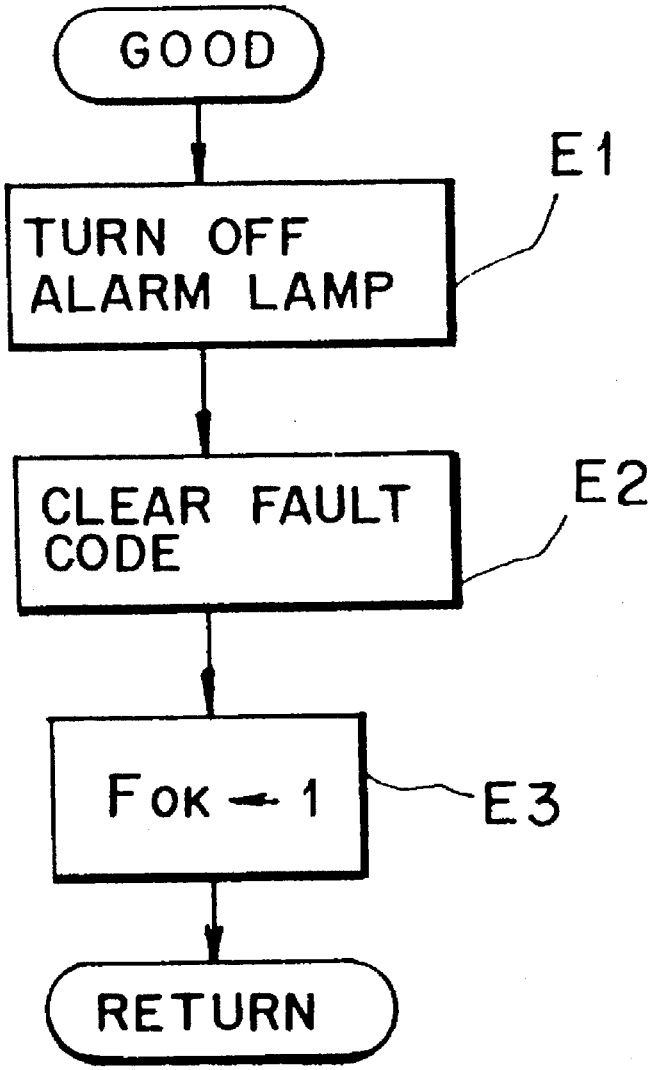
FIG. 7 is a flow chart describing operations by the fault detection system.

When the GOOD subroutine is started, the routine advances as shown in FIG. 7, namely, the alarm lamp 52 is turned off in step El, the fault code is cleared in step E2, and the normality determination end flag $F_{OK}$ is then set at 1 in step E3.

Figure 8:
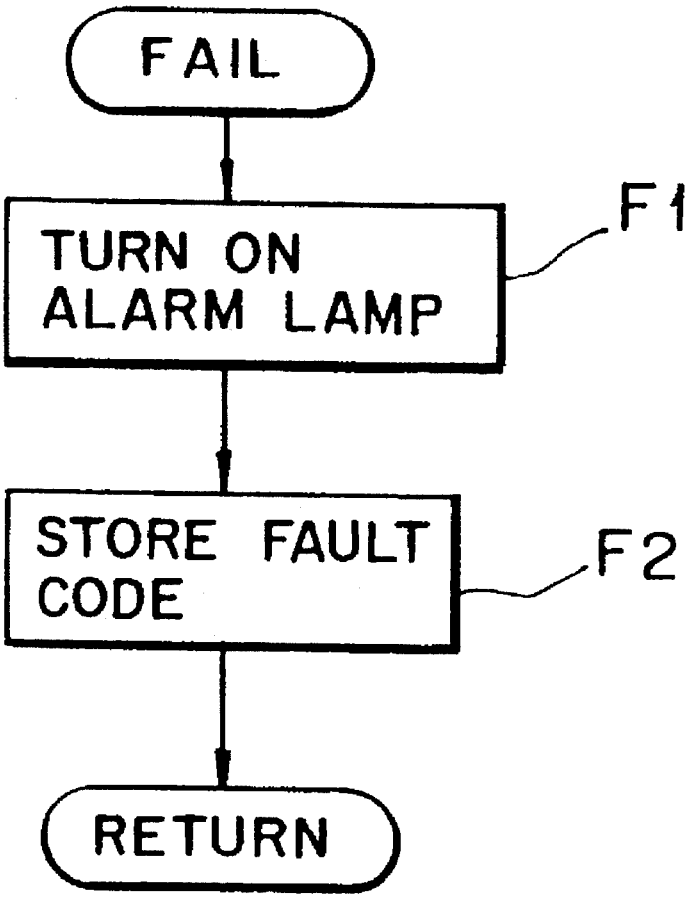
FIG. 8 is a flow chart describing operations by the fault detection system.

When the FAIL subroutine is started, on the other hand, the routine advances as shown in FIG. 8, namely, the alarm lamp 52 is lit in step F1 and a fault code is stored in step F2. This has made it possible to store a fault code on board upon detection of a fault in MODE 1. BY lighting the alarm lamp 52 as described, it is possible to warn the fault to the driver. This makes it possible to prevent him from running without becoming aware of a fault, for example, of the EGR system (for example, sticking of an EGR valve drive system). The storage of the fault code and its subsequent output to the tester 53 or the like can easily indicate the location of the fault at the time of its repair.

Figure 6:
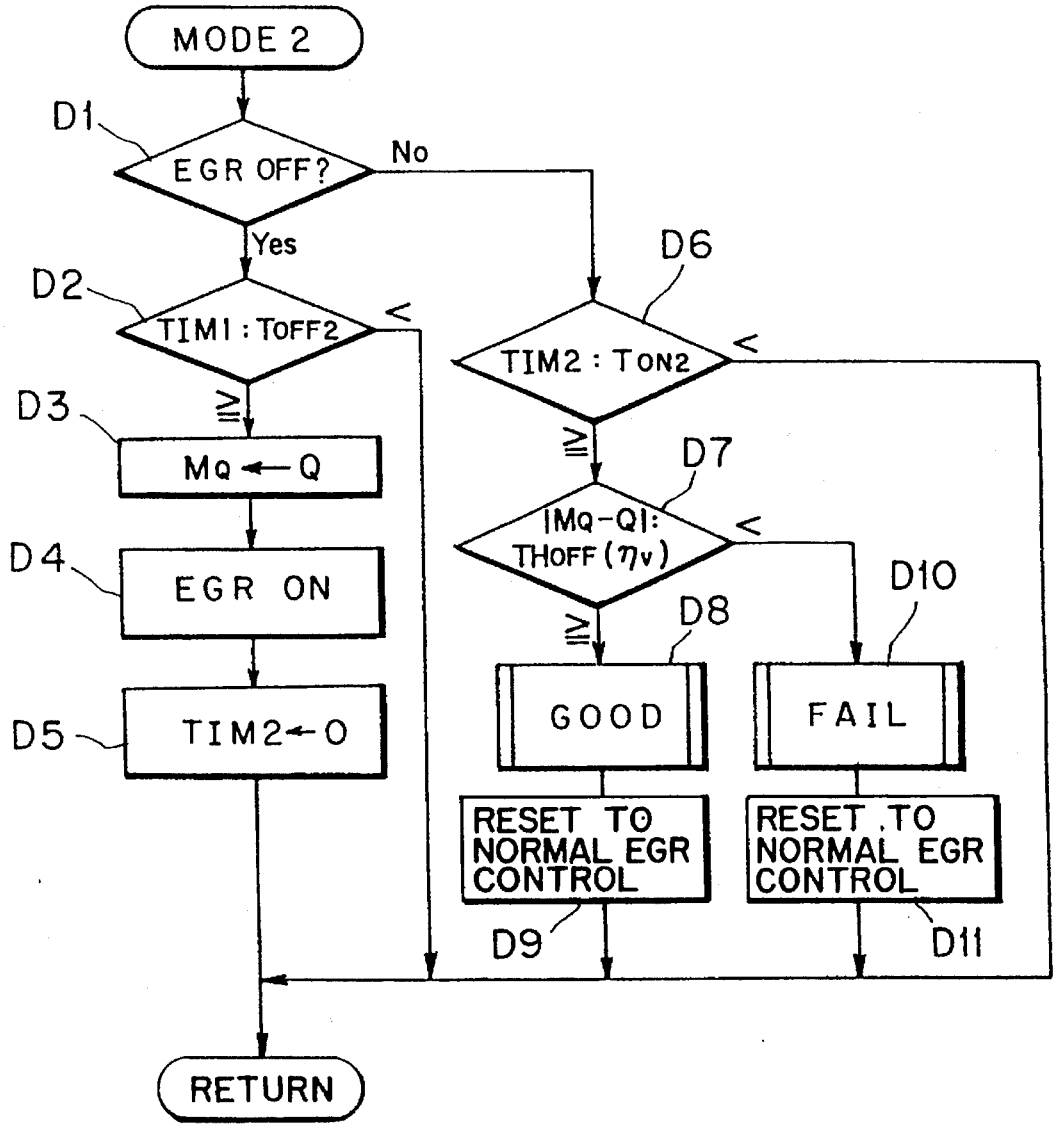
FIG. 6 is a flow chart describing operations by the fault detection system.

When the MODE2 subroutine is started, it is determined as shown in FIG. 6 whether the EGR system is off (the EGR valve is closed) (step D1). In an initial stage after the MODE2 subroutine has been started, the EGR system is off (the EGR valve is closed). It is therefore determined in step D2 whether the count TIM1 of the first timer has reached a preset time $T_{OFF2}$. To determine whether the count TIM1 of the first timer has reached the preset time $T_{OFF2}$ as described above is, for the same reasons as described above, to determine whether the OFF state of the EGR system (the closed state of the EGR valve) has continued for a certain time subsequent to the initialization.

As the count TIM1 of the first timer has not reached the preset time $T_{OFF2}$ in the beginning, the routine returns directly. When the count TIM1 of the first timer has reached the preset time $T_{OFF2}$, the current inducted air volume Q is read in step D3. After opening the EGR valve 81 to turn on the EGR system (step D4), the count TIM2 of the second timer is reset to 0 (step D5).

Since the EGR system has been turned on in step D4, the routine advances taking the NO route in step D1. It is then determined in step D6 whether the count TIM2 of the second timer has reached the preset ON time $T_{ON2}$. No further processing is performed until the count TIM2 of the second timer reaches the preset ON time $T_{ON2}$. Upon an elapsed time of the preset ON time $T_{ON2}$, it is then determined in step D7 whether the change in the output of the air flow sensor 17 between before and after the opening or closure of the EGR valve 81 is not smaller than the predetermined fault determination value. In other words, it is determined whether the difference (absolute value) between an inducted air volume $M_Q$ measured when the EGR system was off, said volume having been read in step D3, and the current inducted air volume Q [measured when the EGR system is on; described correctly, measured at a time point set in view of a lag in a change of inducted air volume (see FIG. 9)] is not smaller than the fault determination value $TH_{OFF}$. In this case, the fault determination value $TH_{OFF}$ is also set by using the state of load on the engine (volumetric efficiency $\eta_v$) as a parameter.

If the difference between the volume of air inducted when the EGR system was off and the volume of air inducted currently (when the EGR system is on) is equal to or greater than the fault determination value $TH_{OFF}$, the EGR system is determined to be in order (step DS) so that the GOOD subroutine is started. In the subsequent step D9, the control is returned to the normal EGR control.

If the difference between the volume of air inducted when the EGR system was off and the volume of air inducted now (when the EGR system is on) is not equal to or greater than the fault determination value $TH_{OFF}$, the EGR system is determined to be out of order so that the FAIL subroutine is started (step D10). In the subsequent step D11, the control is returned to the normal EGR control.

Incidentally, the determination whether the EGR system is in order or out of order is not conducted while the preset ON time $T_{ON2}$ has not elapsed.

When the GOOD subroutine is started, processings as shown in FIG. 7 are conducted as already described above. When the FAIL subroutine is started, processings as shown in FIG. 8 are performed. Upon detection of a fault in this MODE2, it is therefore also possible to store a fault code on board. By lighting the alarm lamp 52, it is also possible to warn the fault to the driver. This makes it possible to prevent him from running without becoming aware of a fault, for example, of the EGR system (for example, sticking of the EGR valve drive system). The storage of the fault code and its subsequent output to the tester 53 or the like can of course easily indicate the location of the fault at the time of its repair.

By avoiding the critical pressure operation zone as a fault determination zone as described above, it has become possible to detect a fault of the EGR system by using the air flow sensor 17 which has been used for the control of fuel to date. Without addition of any special sensor or the like, it is possible to detect with good accuracy that the system is not operating properly. Even when collecting information, for example, for the diagnosis of faults of EGR systems on board, highly reliable information can be obtained, thereby successfully contributing to substantial improvements in services.

In the above-described embodiment, it was determined whether or not the engine is in a steady state by determining whether or not the engine load state $\eta_v$ as determined from the volume of inducted air changed during the fault analysis (step A8). Instead of step A8, determination of a non-steady state can be conducted based on the occurrence or non-occurrence of a change in the throttle position.

In the embodiment described above, the system according to the present invention was described as applied to the engine for an automotive vehicle. The system according to the present invention is not limited to such an application. It can be applied similarly to various engines useful as power sources, and can bring about similar advantages.

What is claimed is:

1. A method for the detection of a fault of an exhaust gas recirculation system, said exhaust gas recirculation system having an exhaust gas recirculation passage connecting a throttle valve downstream side intake passage, which is arranged on a side downstream the position of arrangement of a throttle valve in an internal combustion engine, and an exhaust passage with each other and an exhaust gas recirculation valve inserted in said exhaust gas recirculation passage, whereby said exhaust gas recirculation valve is opened or closed to selectively recirculate exhaust gas in the exhaust passage to a side of said intake passage through said exhaust gas recirculation passage, which comprises:

opening or closing said exhaust gas recirculation valve upon detection of the engine operation state that the pressure difference between a pressure within said throttle valve downstream side intake passage and a pressure within a throttle valve upstream side intake passage on an upstream side of said position of arrangement of said throttle valve is not greater than a critical pressure; and detecting a change in the volume of air inducted through said throttle valve upstream side intake passage between before and after the opening or closing of said exhaust gas recirculation valve, and if the change in the volume of inducted air is determined smaller than a predetermined fault determination value, determining that the exhaust gas recirculation system is not operating properly.

2. A fault detection system for an exhaust gas recirculation system having an exhaust gas recirculation passage connecting a throttle valve downstream side intake passage, which is arranged on a side downstream the position of arrangement of a throttle valve in an internal combustion engine, and an exhaust passage with each other and an exhaust gas recirculation valve inserted in said exhaust gas recirculation passage, whereby said exhaust gas recirculation valve is opened or closed to selectively recirculate exhaust gas in the exhaust passage to a side of said intake passage through said exhaust gas recirculation passage, which comprises:

means for detecting the volume of air inducted through a throttle valve upstream side intake passage on an upstream side of said position of arrangement of said throttle valve, said inducted air volume detection means being disposed in said throttle valve upstream side intake passage;

means for detecting the state of operation of the engine that the pressure difference between a pressure within said throttle valve downstream side intake passage and a pressure within said throttle valve upstream side intake passage is not greater than a critical pressure;

means for opening or closing said exhaust gas recirculation valve upon detection by said engine operation state detection means of the engine operation state that the pressure difference between the pressure within said throttle valve downstream side intake passage and the pressure within the throttle valve upstream side intake passage is not greater than the critical pressure; and means for detecting that said exhaust gas recirculation system is not operating properly when a change in the output of said inducted air volume detection means between before and after the opening or closing of said exhaust gas recirculation valve has been determined to be smaller than a predetermined fault determination value.

3. A fault detection system according to claim 2, wherein the fault determination value retained by said system operation fault detection means has been set using the state of load on said internal combustion engine as a parameter.

4. A fault detection system according to claim 2, further comprising means for inhibiting normal operation of said exhaust gas recirculation control means, said normal operation opening or closing said exhaust gas recirculation valve depending on the state of operation of said internal combustion engine, during operations of said exhaust gas recirculation opening/closing means and said system operation fault detection means.

5. A fault detection system according to claim 2, further comprising means for displaying determination of a fault in the operation of said exhaust gas recirculation system upon detection of the fault by said system operation fault detection means.

6. A fault detection system according to claim 2, further comprising memory means for storing detection of a fault in the operation of said exhaust gas recirculation system upon detection of the fault by said system operation fault detection means and tester means for permitting output of information on the fault in the operation of said exhaust recirculation system, said fault having been stored in said memory means.

7. A fault detection system according to claim 2, further comprising:

means for detecting the temperature of coolant of said internal combustion engine;

means for detecting the temperature of air inducted into said internal combustion engine; and means for inhibiting operation of said exhaust gas recirculation valve opening/closing means when one of the coolant temperature detected by said coolant temperature detection means and the inducted air temperature detected by said inducted air temperature detection means is smaller than a preset value.

8. A fault detection system according to claim 7, wherein said operation inhibiting means inhibits initiation of operations of said exhaust gas recirculation opening/closing means and said system operation fault detection means when one of the coolant temperature detected by said coolant temperature detection means and the inducted air temperature detected by said inducted air temperature detection means has been detected to be smaller than the preset value prior to the initiation of operations of said exhaust gas recirculation opening/closing means and said system operation fault detection means.

9. A fault detection system according to claim 2, wherein said engine operation state detection means compares the state of load on the internal combustion engine with a predetermined threshold and when the state of load on the internal combustion engine is found to be greater than the threshold on the basis of the results of the comparison, detects the engine operation state that the pressure difference is not greater than the critical pressure.

10. A fault detection system according to claim 9, wherein said engine operation state detection means is provided with means for changing the threshold depending on whether said exhaust gas recirculation valve is open or closed.

11. A fault detection system according to claim 10, wherein a threshold for the case that said exhaust gas recirculation valve is open is set greater than a threshold for the case that said exhaust gas recirculation valve is closed.

12. A fault detection system according to claim 2, wherein irrespective of the position of the exhaust gas recirculation valve, said exhaust gas recirculation valve opening/closing means opens or closes said exhaust gas recirculation valve upon detection of the engine operation state that the pressure difference is not greater than said critical pressure.

13. A fault detection system according to claim 12, wherein said exhaust gas recirculation valve opening/closing means is provided with:

means for holding said exhaust gas recirculation valve in an open position for a predetermined time upon detection of the engine operation state that the pressure difference is not greater than the critical pressure when said exhaust gas recirculation valve is in a closed position in the initial state; and means for returning said exhaust gas recirculation valve into the closed position after holding said exhaust gas recirculation valve in the open position for the predetermined time by said exhaust gas recirculation valve position holding means.

14. A fault detection system according to claim 12, wherein said exhaust gas recirculation valve opening/closing means is provided with:

means for holding said exhaust gas recirculation valve in a closed position for a predetermined time upon detection of the engine operation state that the pressure difference is not greater than the critical pressure when said exhaust gas recirculation valve is in an open position in the initial state; and means for returning said exhaust gas recirculation valve into an open position after holding said exhaust gas recirculation valve in the closed position for the predetermined time by said exhaust gas recirculation valve position holding means.

15. A fault detection system according to claim 2, further comprising:

means for detecting the state of operation of said internal combustion engine;

means for determining whether or not the state of operation of said internal combustion engine detected by said operation state detection means is stable; and means for inhibiting operation of said exhaust gas recirculation valve opening/closing means when the state of operation of said internal combustion engine has been determined instable by said determination means.

16. A fault detection system according to claim 15, wherein said operation inhibiting means inhibits initiation of operations of said exhaust gas recirculation opening/closing means and said system operation fault detection means when the state of operation of said internal combustion engine has been determined instable during operations of said exhaust gas recirculation opening/closing means and said system operation fault detection means.

17. A fault detection system according to claim 15, wherein said operation inhibiting means inhibits continuation of operations of said exhaust gas recirculation opening/closing means and said system operation fault detection means when the state of operation of said internal combustion engine has been determined instable during operations of said exhaust gas recirculation opening/closing means and said system operation fault detection means.

* * * * *